US005791051A

United States Patent [19]

Schmidt

[11] Patent Number: 5,791,051

[45] Date of Patent: Aug. 11, 1998

[54] CIGAR CUTTER

[75] Inventor: G. Gerry Schmidt, Newport Beach, Calif.

[73] Assignee: Pacific Handy Cutter, Costa Mesa, Calif.

[21] Appl. No.: 746,013

[22] Filed: Nov. 5, 1996

[51] Int. Cl.[6] ..... A24F 13/24

[52] U.S. Cl. ..... 30/113; 131/248

[58] Field of Search ..... 30/113, 241, 111; 131/248, 250, 252, 253

[56] References Cited

U.S. PATENT DOCUMENTS

| | | | |
|---|---|---|---|
| D. 23,579 | 8/1894 | Walters . | |
| D. 147,120 | 5/1947 | Dietrich . | |
| 827,558 | 7/1906 | Niell . | |
| 1,021,849 | 4/1912 | Schwieger . | |
| 1,061,236 | 5/1913 | Fuller | 30/113 |
| 1,066,365 | 7/1913 | Battin | 30/113 |
| 1,082,257 | 12/1913 | Astruck | 30/113 |
| 1,086,463 | 2/1914 | Robbins | 30/113 |
| 1,119,220 | 12/1914 | Bates | 30/113 |
| 1,143,463 | 6/1915 | Terwilliger, Jr. . | |
| 1,166,881 | 1/1916 | Anderson | 30/113 |
| 1,237,023 | 8/1917 | Davidson . | |
| 1,450,674 | 4/1923 | Marston . | |
| 1,509,311 | 9/1924 | Perry . | |
| 1,770,920 | 7/1930 | Hermani . | |
| 2,010,440 | 8/1935 | Ryan . | |
| 2,365,185 | 12/1944 | Gailey . | |
| 2,862,779 | 12/1958 | Hammond . | |
| 4,997,082 | 3/1991 | Durocher . | |
| 5,011,009 | 4/1991 | Scheurer . | |

FOREIGN PATENT DOCUMENTS

| | | |
|---|---|---|
| 572673 | 3/1933 | Germany . |

*Primary Examiner*—Eugenia Jones
*Attorney, Agent, or Firm*—Oppenheimer Wolff & Donnelly LLP

[57] ABSTRACT

A cigar cutter comprising a housing having a cigar tip receiving aperture, a cigar tip cutoff blade having an inclined cutting edge, and a blade mounting slide telescopically fitted to the housing and adapted to be manually operated to move the blade to cut off a cigar tip inserted through the aperture. A guide on the slide engages a guide receiving channel in the housing; the slide is guided to slide into and out of the housing, and to move the blade past the aperture to a fully inserted position. A spring disposed in the channel above the guide biases the slide outwardly from the housing. The blade is mounted on the slide with the cutting edge facing generally away from and at an angle to the guide. When the slide is manipulated into the housing against the bias of the spring, forces exerted on the slide by the blade during cutting of a cigar force the slide laterally within the housing, pressing the guide against the channel. A preferred version of the present invention also incorporates a push-button release system for retaining the slide in the housing when the slide is fully inserted. The push-button release system comprises the following elements: a resilient catch portion and a slot in the slide, a push-button protruding from the catch portion, a depression shaped to receive a human finger and formed on the housing, and a push-button release hole located within the depression.

15 Claims, 3 Drawing Sheets

Fig. 7.
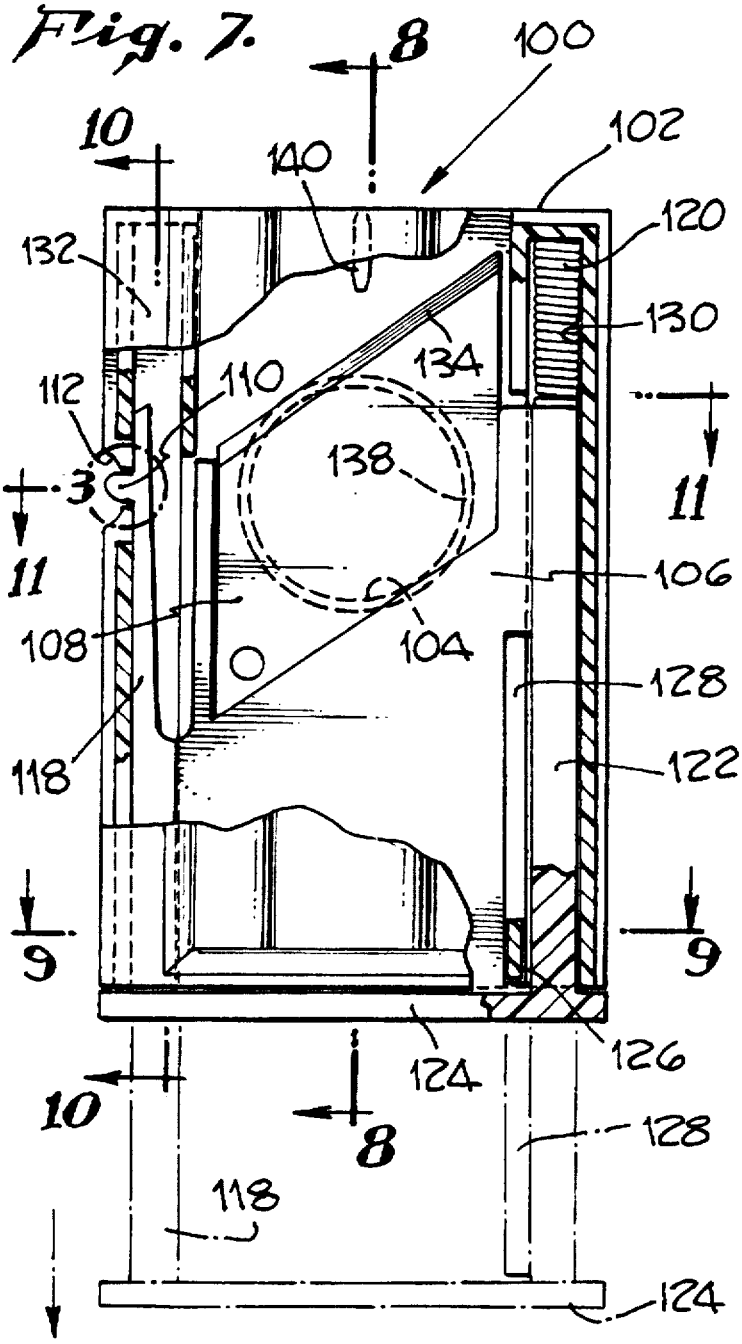
Fig. 8.
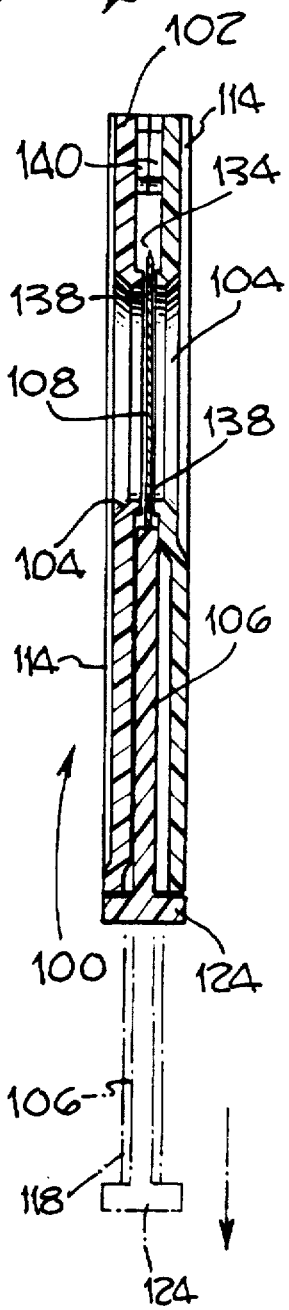
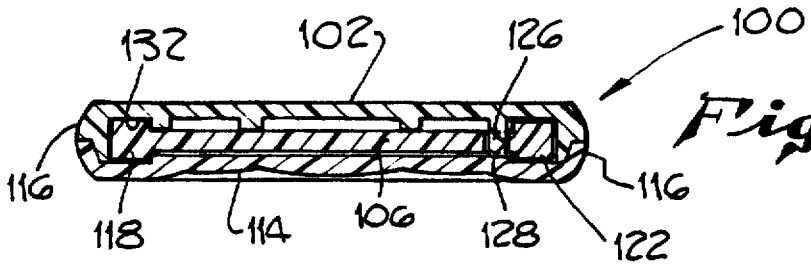
Fig. 9.

CIGAR CUTTER

BACKGROUND OF THE INVENTION

1. Field of Invention

The present invention relates to a cutter for removing the ends of cigars and, more particularly, pertains to a cigar cutter with an integrated slide member/blade element, spring mechanism for ejecting the slide member from the cigar cutting housing, and a catch mechanism for releasably securing the slide member within the housing.

2. Description of the Related Art

Fine cigars include an outer leaf which is carefully selected to provide a cigar which burns evenly and produces a pleasing and flavorful smoke. The outer leaf also serves as an outer support structure which holds the cigar together and provides a conduit through which smoke is more easily drawn. The cigar smoking experience is optimized by cutting away the tip of the cigar from which smoke is drawn so that the smoke may be more easily drawn through the length of the cigar. When cutting a cigar tip, one must exercise care and use an appropriate cutting tool lest the outer leaf of the cigar be inadvertently damaged. Such damage is problematic because a serious breach in the outer leaf impairs the ability of a cigar smoker to efficiently draw smoke through the length of the cigar.

Although a variety of cigar cutters are known, they typically suffer from a number of problems, including undue complexity and inconsistent performance that results in damage to the outer leaf of the cigar. Presently, there exists a need for a reliable and affordably constructed cigar cutter which is not only compact and of a low profile suitable for shirt pocket portability but which also includes a variety of advanced performance features such an integrated push-button release system.

SUMMARY OF THE INVENTION

In accordance with a specific illustrative embodiment of the present invention, a cigar cutter includes a housing having a cigar tip receiving aperture, a cigar tip cutoff blade, and a blade mounting slide telescopically fitted to the housing and adapted to be manually operated to move the blade within the housing to cut off the tip of a cigar inserted in the aperture. A guide on the slide engages a guide receiving channel in the housing; the slide is guided to slide into and out of the housing, and to move the blade past the aperture to a fully inserted position. A spring disposed in the channel above the guide biases the slide outwardly from the housing. The blade has an inclined cutting edge. The blade is mounted on the slide with the cutting edge facing generally away from and at an angle to the guide. When the slide is manipulated into the housing against the bias of the spring, forces exerted on the slide by the blade during cutting of a cigar placed in the aperture force the slide laterally within the housing, pressing the guide against the channel.

In a further aspect of the present invention, the cigar cutter further includes a push-button release system, which retains the slide in the housing when the slide is fully inserted. The push-button release system comprises the following elements: Opposite the guide, the slide has a slot and a catch portion, and a push-button protruding from the catch portion; the housing includes a depression shaped to receive a human finger, and a push-button release hole located within the depression. When the push-button engages the housing, the slot permits deflection of the catch portion of the slide, which is formed of resilient material, toward the center of the slide, thus allowing further insertion of the slide into the housing. When the slide advances as far as the center of the depression, the push-button aligns with the hole and the catch portion springs back to its normal shape, forcing the push-button through the hole and thus securely retaining the slide inside the housing. The slide is removed simply by depressing the push-button and simultaneously exerting a removal force on the slide.

In a broader aspect of the present invention, the cigar cutter includes: a housing having a channel, the housing also having an aperture sized to receive cigars; a slide member including a blade mounted thereto, the slide member being slidably fitted within the channel so that the slide member may be manipulated to move the blade across the aperture to cut off the tip of a cigar inserted through the aperture; a bias mechanism for applying a force to the slide member, the force tending to eject the slide member from the housing; and a catch mechanism for releasably securing the slide member within the housing.

BRIEF DESCRIPTION OF THE DRAWINGS

Other objects, features and advantages of the invention will become readily apparent upon reference to the following detailed description when considered in conjunction with the accompanying drawings, in which like reference numerals designate like part throughout the figures thereof, and wherein:

FIG. 7 is a cross-sectional front view of the cigar cutter of FIG. 1;

FIG. 8 is a cross-sectional view along the plane 8—8 in FIG. 7.

FIG. 9 is a cross-sectional view along the plane 9—9 in FIG. 7.

DETAILED DESCRIPTION OF THE PREFERRED EMBODIMENTS

Figure 1:
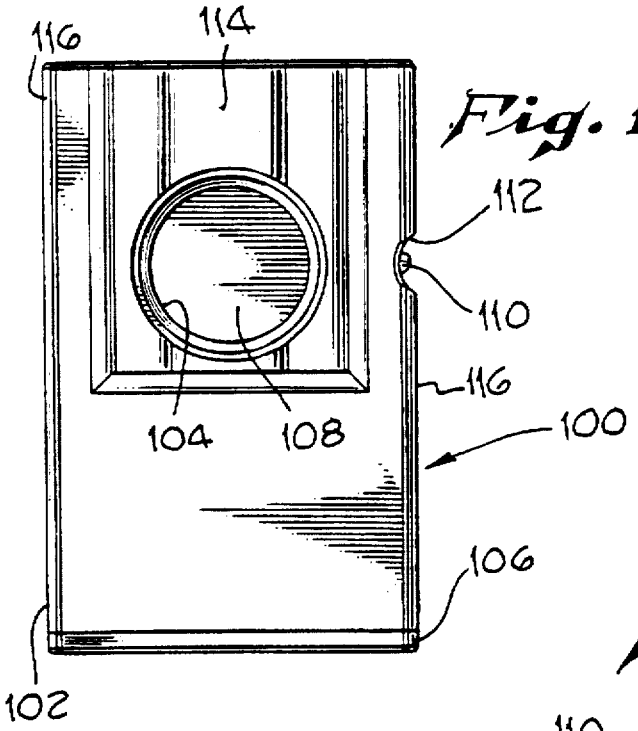
FIG. 1 is a front view of a preferred exemplary embodiment of the cigar cutter of the present invention.

Referring initially to FIG. 1, a preferred exemplary embodiment of the cigar cutter 100 of the present invention includes a housing 102 with a cigar tip receiving aperture 104 sized to received cigars therethrough. The cigar cutter 100 also includes a slide 106 and a blade 108 mounted thereto. The slide 106 and the blade 108 are releasably secured within the housing 102 by a semi-flexible latching member 118 of the slide 106. Only a securing tab portion 110 of the latching member 118 is visible in FIG. 1. A depression 112 is provided so that the exposed security tab portion 110 of the latching member remains flush with the edge of the housing 102.

Figure 2:
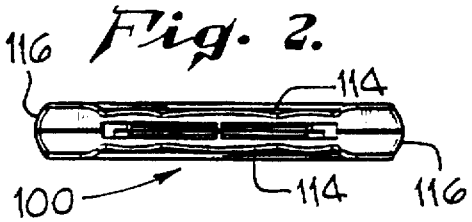
FIG. 2 is a top view of the cigar cutter of FIG. 1.
Figure 6:
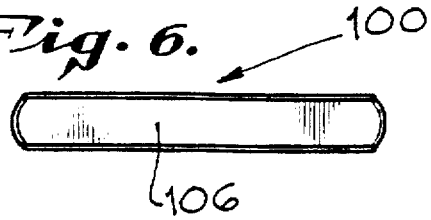
FIG. 6 is a bottom view of the cigar cutter of FIG. 1.
Figure 3:
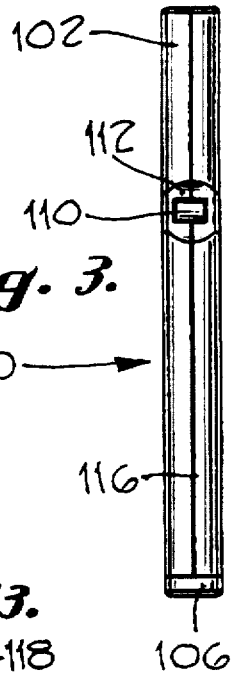
FIG. 3 is a right side view of the cigar cutter of FIG. 1.
Figure 5:
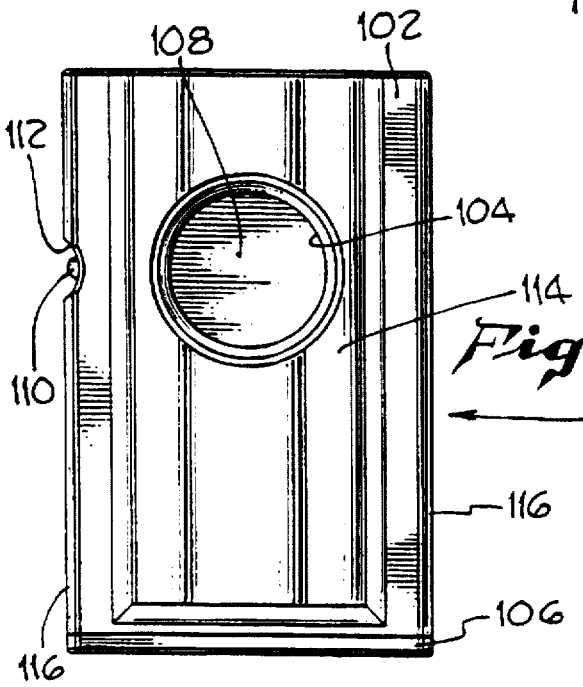
FIG. 5 is a rear view of the cigar cutter of FIG. 1.
Figure 4:
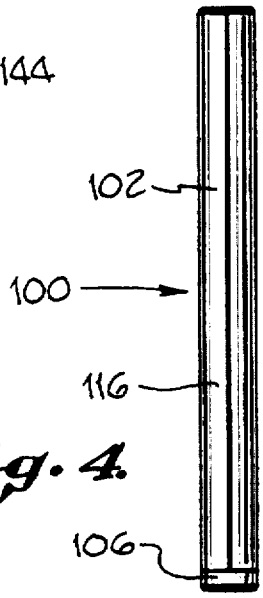
FIG. 4 is a left side view of the cigar cutter of FIG. 1.

Referring now to FIG. 2, which is a top view of the cigar cutter 100 of FIG. 1, the housing 102 preferably, but not necessarily, includes concave face portions 114 and curved side walls 116. The cigar cutter 100 may be secured to other objects, for example, a cigar humidor, by providing the other objects with surfaces complementary to the curved sidewalls 116 and the face portions 114. As shown in FIG. 2, the housing 102 is preferably formed of two halves which are sonic welded together during assembly, after the component parts are inserted into the housing 102. Right and left side views of the cigar cutter 100 are respectively presented in FIGS. 3 and 4 and illustrate that the housing 102 is preferably shaped to have a low profile suitable for readily transporting the cigar cutter 100 in a shirt pocket. Referring to FIG. 5, which is a rear view of the cigar cutter 100 of FIG. 1, the housing 102 is constructed such that the cigar tip receiving aperture 104 is formed on both the front and rear sides thereof. The bottom view of the cigar cutter 100 presented in FIG. 6 further shows that the housing 102 is preferably narrow in profile.

Referring now to FIG. 7 which is a cross-sectional front view of the cigar cutter 100, the latching member 118 is shown in a latched position securing the slide 106 within the housing 102. FIG. 7 also shows the slide 106 sliding downward and out of the housing 102. The slide 106 is formed as shown such that the blade 108 can be securely mounted thereto. The cigar cutter 100 includes a spring 120 shown fully compressed between the housing 102 and a guide portion 122 of the slide 106. A counter force exerted by the spring 120 assists in ejecting the slide 106 from the housing 102.

The spring 120 is disposed in a track or channel 130 above the guide 122 biasing the slide 106 outwardly from the housing 102. The spring 120 is compressed when the slide 106 is fully inserted into the housing 102. The spring 120 acts to control the rate of cutting; thus, a spring 120 of an appropriate strength is selected in order to reduce any tendency of the cigar cutter 100 to cause tears or other damage to the cigar through an uneven or abrupt motion of the slide 106 through the housing 102.

As best shown in FIG. 8, an edge or flange 124 is connected to the slide 106 thereby providing a positive mechanical stop against further insertion of the slide 106 into the housing 102. The flange 124 prevents the blade 108 from making contact with the top of the housing 102 and thus protects the housing 102 from being cut.

Referring to FIG. 9, a stationary stop 126 is molded to the housing 102 as shown. As best shown in FIG. 7, a slit 128, sized to receive the stationary stop 126 therein, is formed on the slide 106. The stop 126 prevents the slide 106 from being completely removed from the housing 102.

Figure 10:
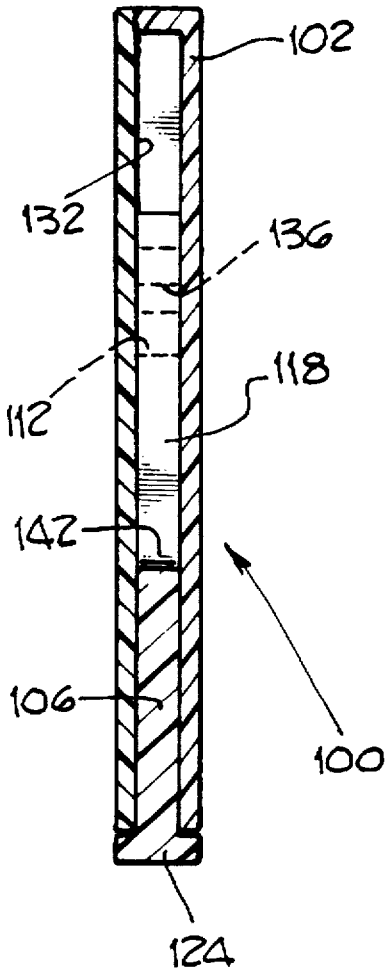
FIG. 10 is a cross-sectional view along the plane 10—10 in FIG. 7.
Figure 11:
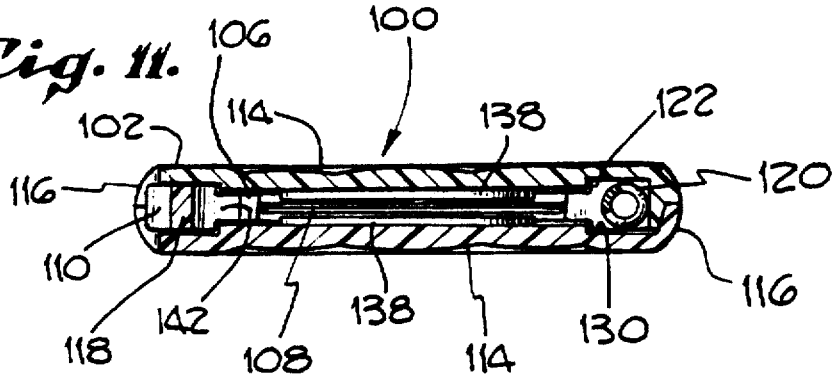
FIG. 11 is a cross-sectional view along the plane 11—11 in FIG. 7.

Referring to FIG. 10, which is a cross-sectional view along the plane 10—10 in FIG. 7, the latching member 118 is shown fitted within a track or channel 132 of the housing 102. Referring to FIG. 11, which is a cross-sectional view along the plane 11—11 in FIG. 7, the end of the spring 120 which makes contact with the guide portion 122 is best seen. FIG. 11 also shows that the latching member 118 and the guide portion 122 are substantially rectangular in shape with the channels 132, 130, respectively, being correspondingly formed in the housing 102 to facilitate a sliding motion of the slide 106 within the housing 102. As may be readily appreciated, the latching member 118 and the guide portion 122 and their respective channels 132, 130 may be formed in other complimentary shapes facilitating the aforementioned sliding motion.

Figure 12:
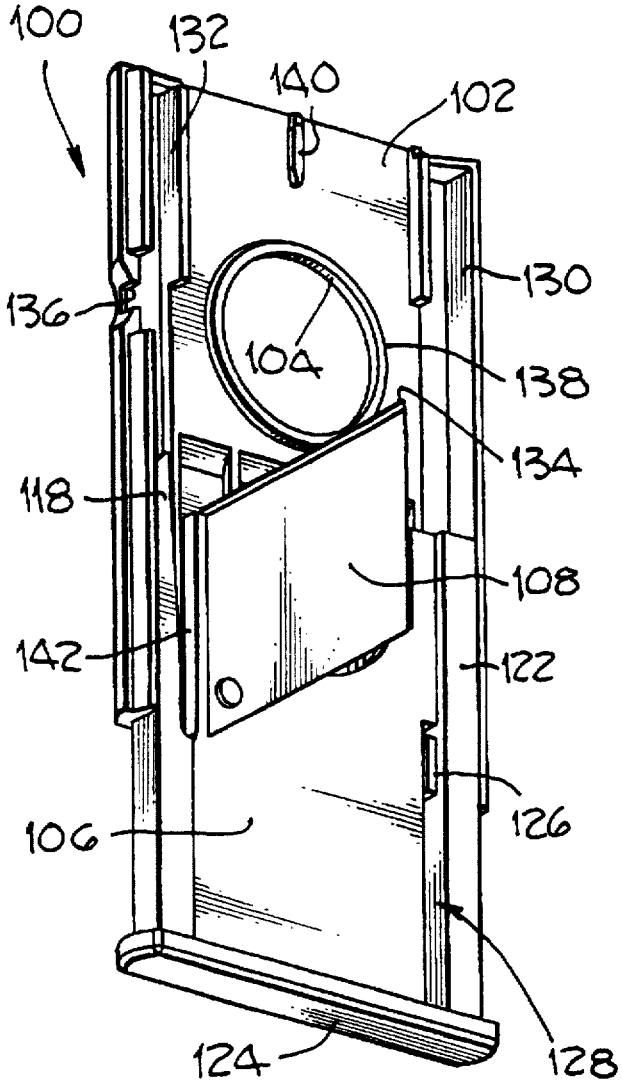
FIG. 12 is a cross-sectional perspective view of the cigar cutter of FIGS. 1 through 11.

Referring to the cross-sectional perspective view of the cigar cutter 100 shown in FIG. 12, the blade 108 includes a cutting edge 134 and is fitted into the slide 106 with the cutting edge 134 facing away from the bottom edge 124 of the slide 106. FIG. 12 best illustrates the tracks or channels 132, 130 within which the latching member 118 and the guide portion 122 slide, respectively. As shown in FIG. 7, the housing 102, slide 106 and spring 120 are preferably sized such that the spring 120 fits within the channel 130 and is almost completely compressed when the cigar cutter 100 is in the latched configuration shown. As best illustrated in FIG. 12, the housing 102 additionally includes a push-button release hole 136 through which the securing tab portion 110 extends to secure the slide 106 within the housing 102.

Referring again to FIG. 12, the cigar tip receiving aperture 104 is formed from a beveled ring 138. The dimensions of the stationary stop 126, slit 128, blade 108 and beveled ring 138 are selected such that the blade 108 remains supported by the beveled ring 138 even when the slide 106 is in its fully extended position, thereby preventing the blade 108 from dropping down and inadvertently cutting the plastic beveled ring 138.

The housing 102 also includes a standoff member 140 formed thereon as shown in FIG. 12. The standoff 140 supports the end of the housing 102 facing the cutting edge 134 of the blade 108; it also provides a "broken wall" through which cigar cuttings may be ejected from the cigar cutter 100. The standoff 140 is angled at both ends to facilitate easy removal of the cigar cuttings from the housing 102.

Although the cutting edge 134 is preferably inclined as shown in FIG. 12, it may alternatively comprise a curved blade such as a concave blade which substantially follows the contour of the cigar's outer leaf when the cutting edge 134 first makes contact with the cigar.

When the slide 106 is manipulated into the housing 102, against the bias of the spring 120 (not shown in FIG. 12), forces exerted on the slide 106 by the blade 108 during the cutting of a cigar placed through the aperture 104 force the slide 106 laterally within the housing 102 pressing the guide 122 against the channel 130. Similarly, the semi-flexible latching member 118 and its securing tab portion 110 make contact along the channel 132 during the aforementioned lateral movement of the slide 106 within the housing 102.

In FIG. 12, the slide 106 is shown in an extended position allowing a cigar to be inserted through the aperture 104 for cutting. The latching member 118 flexes along a substantially U-shaped or flute shaped channel or slot 142 formed between the latching member 118 and the main body of the slide 106, on the opposite side of the slide 106 from the guide portion 122, allowing the slide 106 to be partially withdrawn from the housing 102 as shown. The housing 102, slide 106 and spring 120 are preferably sized such that the spring 120 is not substantially compressed when the slide 106 is in its extended position.

The slot 142 permits deflection of the securing tab 110 toward the center of the slide 106, thus allowing insertion of the slide 106 into the housing 102. As shown in FIG. 7, when the slide 106 advances as far as the center of the depression 112, the tab or push-button 110 aligns with the hole 136 and the latching member 118 springs back to its normal shape, forcing the tab portion 110 through the hole 136 and thus securely retaining the slide 106 within the housing 102. The slide 106 is removed by depressing the securing tab 110 and simultaneously applying a removal force to the slide 106.

Figure 13:
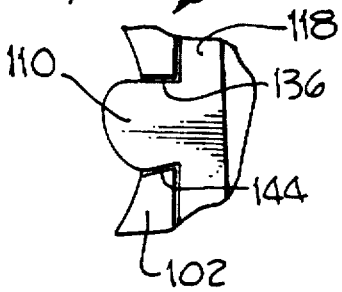
FIG. 13 is an enlarged cross-sectional view of the cigar cutter securing tab along circle 13 in FIG. 7.

And finally, FIG. 13 is an enlarged view of the securing tab 110 protruding through the release hole 136 when the slide 106 is in its closed position. The securing tab 110 includes an angled surface 144 which provides a reverse angle locking feature with the housing 102 as shown.

The slide 106 is preferably formed from a moldable, linear polyoxymethylene-type acetal resin material. Alternatively, other resilient and sufficiently lubricative materials may be employed. The housing 102 is preferably formed from an ABS (Acrylonitrile butadiene-styrene) plastic or a similarly rigid and durable material within which DELRIN or an equivalent material can slide as required.

In conclusion, it is to be understood that the foregoing detailed description and accompanying drawings illustrate the principals of the invention. However, various changes and modifications may be employed without departing from the spirit and scope of the invention. Thus, by way of example and not of limitation, the cigar cutter 100 may alternatively employ a plurality of cutting blades instead of the single blade configuration discussed above. Accordingly, the present invention is not limited to the specific form shown in the drawings and described in detail above.

What is claimed is:

1. A cigar cutter device comprising:

a housing having a cigar tip receiving aperture;

a cigar tip cutoff blade having an inclined cutting edge;

a blade mounting slide to which the blade is attached, the slide being telescopically fitted to the housing and adapted to be manually operated to move the blade within the housing to cut off the tip of a cigar inserted in the housing aperture; and the slide includes a guide and the housing includes a guide receiving channel formed such that the slide is guided by the channel to slide inwardly and outwardly of the housing to move the blade past the aperture;

a spring for biasing the slide outwardly of the housing, the spring being disposed in the channel above the guide such that when the slide is manipulated into the housing against the bias of the spring, forces exerted on the slide by the blade during cutting of a cigar placed in the aperture force the slide laterally within the housing, pressing the guide against the channel;

the slide including a catch portion which defines a substantially U-shaped slot and including a latching member with a push-button protruding therefrom;

the housing including a depression formed on a side of the housing adjacent the catch portion, the depression being shaped to receive a human finger, the depression including a push-button release hole;

the catch portion being formed such that, when the push-button engages the housing during insertion of the slide, the slot permits deflection of the latching member so that the slide may slide within the housing and, when the push-button aligns with the hole, the latching member springs back to its normal shape forcing the push-button through the hole thereby retaining the slide within the housing.

2. The cigar cutter device of claim 1, wherein the slide further includes a flange that provides a positive mechanical stop against further insertion of the slide into the housing.

3. The cigar cutter device of claim 1, wherein the slide is formed of a moldable linear polyoxymethylene-type acetal resin material.

4. The cigar cutter device of claim 1, wherein the housing is formed of Acrylonitrile-butadiene-styrene (ABS).

5. A cigar cutter device comprising:

a housing having a cigar tip receiving aperture;

a cigar tip cutoff blade having an inclined cutting edge;

a blade mounting slide to which the blade is attached, the slide being telescopically fitted to the housing and adapted to be manually operated to move the blade within the housing to cut off the tip of a cigar inserted in the housing aperture;

the slide includes a guide and the housing includes a guide receiving channel formed such that the slide is guided by the channel to slide inwardly and outwardly of the housing to move the blade past the aperture;

a spring for biasing the slide outwardly of the housing, the spring being disposed in the channel above the guide, such that when the slide is manipulated into the housing against the bias of the spring, forces exerted on the slide by the blade during cutting of a cigar place in the aperture force the slide laterally within the housing, pressing the guide against the channel; and a flange connected to the slide that provides a positive mechanical stop against further insertion of the slide into the housing;

the slide including a catch portion which defines a substantially U-shaped slot and includes a latching member with a push-button protruding therefrom;

the housing including a depression formed on a side of the housing adjacent the catch portion, the depression being shaped to receive a human finger, the depression including a push-button release hole;

the catch portion being formed such that when the push-button engages the housing during insertion of the slide, the slot permits deflection of the latching member so that the slide may be manipulated into the housing, and when the push-button aligns with the hole, the latching member springs back to its normal shape, forcing the push-button through the hole and thereby retaining the slide inside the housing.

6. The cigar cutter device according to claim 5, wherein the slide is formed of a moldable, linear polyoxymethylene-type acetal resin material.

7. The cigar cutter device of claim 5, wherein the housing is formed of Acrylonitrile-butadiene-styrene (ABS).

8. A cigar cutter device comprising:

a housing having a channel, the housing also having an aperture sized to receive cigars;

a slide member including a blade mounted thereto, the slide member being slidably fitted within the channel so that the slide member may be manipulated to move the blade across the aperture to cut off the tip of a cigar inserted through the aperture;

a spring positioned within the housing and configured to apply a force to the slide member, the force tending to eject the slide member from the housing; and the slide member including a catch portion which defines a substantially U-shaped slot and includes a latching member with a push-button protruding therefrom;

the housing including a depression formed on a side of the housing adjacent the catch portion, the depression being shaped to receive a human finger, the depression including a push-button release hole;

the catch portion being formed such that, when the push-button engages the housing during insertion of the slide member, the slot permits deflection of the latching member so that the slide member may slide within the housing and, when the push-button aligns with the hole, the latching member springs back to its normal shape forcing the push-button through the hole thereby retaining the slide member within the housing.

9. The cigar cutter device of claim 8, wherein:

the slide member includes a guide and the channel in the housing includes a guide receiving channel formed such that the slide member is guided by the channel to slide inwardly and outwardly of the housing; and the spring is disposed in the guide receiving channel above the guide.

10. The cigar cutter device of claim 9, wherein the spring length and position are chosen such that the guide begins compressing the spring before the blade enters the aperture, and forces exerted on the slide member by the spring and the blade during cutting of a cigar force the slide member laterally within the housing, pressing the guide against the guide receiving channel.

11. The cigar cutter device of claim 8, wherein the slide member further includes a flange that provides a positive mechanical stop against further insertion of the slide member into the housing.

12. The cigar cutter device of claim 8, wherein the slide member is formed of a moldable, linear polyoxymethylene-type acetal resin material.

13. The cigar cutter device of claim 8, wherein the housing is formed of Acrylonitrile-butadiene-styrene (ABS).

14. The cigar cutter device of claim 8, further comprising:

a stop formed on said housing and adapted to prevent said slide member from being manipulated within the channel such that said slide member is mechanically decoupled from said housing.

15. The cigar cutter device of claim 14, further comprising:

a beveled ring formed around the aperture;

said stop means maintaining the blade within said housing such that the blade is supported by said beveled ring.

* * * * *